US005406649A

United States Patent [19]

Bolembach

[11] Patent Number: 5,406,649

[45] Date of Patent: Apr. 18, 1995

[54] SANITARY DISPOSABLE HAND COVERING

[76] Inventor: John Bolembach, 17 Lincoln Pl., Staten Island, N.Y. 10305

[21] Appl. No.: 948,653

[22] Filed: Sep. 23, 1992

[51] Int. Cl.[6] ..... A41D 19/00

[52] U.S. Cl. ..... 2/158; 2/159; 2/162

[58] Field of Search ..... 2/158, 159, 161 R, 162, 2/167, 168, 169, 163; 15/227

[56] References Cited

U.S. PATENT DOCUMENTS

| | | | |
|---|---|---|---|
| 2,069,643 | 2/1937 | Burke | 2/162 X |
| 2,139,897 | 12/1938 | Kessler | 2/158 X |
| 2,670,473 | 3/1954 | Stebic | 2/167 X |
| 3,088,118 | 5/1963 | Clark | 2/158 X |
| 4,194,248 | 3/1980 | Verschaeve | 2/168 X |
| 4,476,588 | 10/1984 | Long | 2/159 X |
| 4,564,956 | 1/1986 | DiBuono | 2/158 X |
| 4,788,733 | 12/1988 | Lerner | 2/159 X |
| 4,845,780 | 7/1989 | Reimers et al. | 2/169 X |
| 4,884,300 | 12/1989 | Vistins | 2/162 |
| 4,937,881 | 7/1990 | Heise | 2/163 X |

*Primary Examiner*—Clifford D. Crowder
*Assistant Examiner*—Paul C. Lewis
*Attorney, Agent, or Firm*—Richard L. Miller

[57] ABSTRACT

A sanitary disposable hand covering is provided which consists of a sheet of thin, flexible waterproof plastic material formed into an enclosure with a cuff, to permit a hand having a thumb and fingers to enter through the cuff for insertion into the enclosure. A mechanism is for restricting the size of the cuff is provided to thereby secure the enclosure about a wrist of the hand.

2 Claims, 1 Drawing Sheet

SANITARY DISPOSABLE HAND COVERING

BACKGROUND OF THE INVENTION

The instant invention relates generally to mittens and more specifically it relates to a sanitary disposable hand covering.

Numerous mittens have been provided in the prior art that are adapted to encase the thumb separately and the four fingers together of a hand, so as to protect and cover the hand. For example, U.S. Pat. Nos. 3,805,297 to Margolis; 4,928,322 to Bradfield and 4,441,026 to Secter all are illustrative of such prior art. While these units may be suitable for the particular purpose to which they address, they would not be as suitable for the purpose of the present invention as hereafter described.

SUMMARY OF THE INVENTION

A primary object of the present invention is to provide a sanitary disposable hand covering that will overcome the shortcomings of the prior art devices.

Another object is to provide a sanitary disposable hand covering that can be quickly placed onto and removed from a hand of a person being a child or adult, so that when entering a rest room or other facility, the hand covering will keep the hand clean.

An additional object is to provide a sanitary disposable hand covering that is fabricated out of a thin, flexible, waterproof plastic material to protect and keep clean the thumb and fingers of the hand of the person.

A yet additional object is to provide a sanitary disposable hand covering that is fabricated out of a thin, flexible, waterproof plastic material to protect and keep clean food preparation and similar articles which the user may be required to examine or manipulate.

A further object is to provide a sanitary disposable hand covering that is simple and easy to use.

A still further object is to provide a sanitary disposable hand covering that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
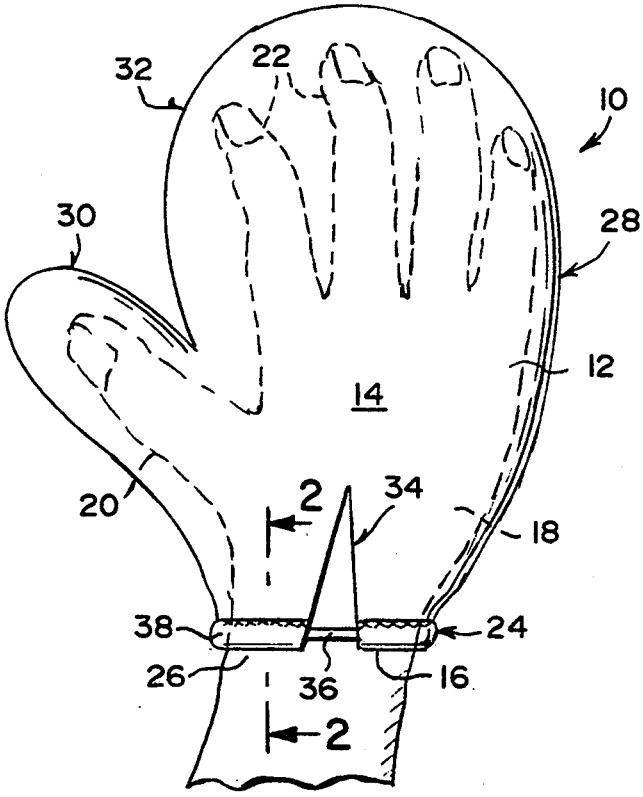
FIG. 1 is a diagrammatic elevational view showing a first embodiment of the instant invention worn on a hand.

Turning now descriptively to the drawings, in which similar reference characters denote similar elements throughout the several views, the Figures illustrate a sanitary disposable hand covering 10 which consists of a sheet 12 of thin, flexible, waterproof plastic material formed into an enclosure 14 with a cuff 16, to permit a hand 18 having a thumb 20 and fingers 22 to enter through the cuff 16 for inserting into the enclosure 14. A mechanism 24 is for securing the cuff 16 about a wrist 26 of the hand. The enclosure 14 may be typically a mitten 28 or a glove with separate fingers (not illustrated) having a thumb portion 30 and a fingers portion 32, so that the thumb portion 30 can be manipulated relative to the fingers portion 32.

Figure 2:
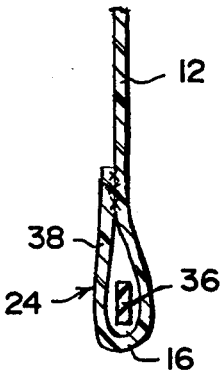
FIG. 2 is an enlarged diagrammatic cross sectional view taken along line 2—2 of FIG. 1.

The cuff securing mechanism 24, as shown in FIGS. 1 and 2 for a first embodiment, includes the sheet 12 having a notch 34 extending inwardly from the cuff 16. A rubber band 36 is also provided. A folded heat sealed hem 38 is formed at the cuff 16 to capture the rubber band 36 therein, which will secure the cuff 16 to the wrist 26.

Figure 3:
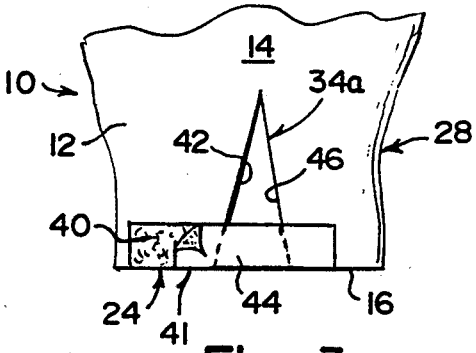
FIG. 3 is an enlarged elevational view with parts broken away illustrating a second embodiment of the invention.

The cuff securing mechanism 24, as shown in FIG. 3, for the second embodiment includes the sheet 12 having a notch **34*a* extending inwardly from the cuff 16. A first strip 40 of a mating hook and loop pile fabric fastener 41 is affixed at a first side 42 of the notch 34*a* adjacent the cuff 16. A second strip 44 of the mating hook and loop pile fabric fastener 41 is affixed at and extending across a second side 46 of the notch 34*a* adjacent the cuff 16, so as to mate with the first strip 40, which will secure that cuff 16 to the wrist 26**.

Figure 4:
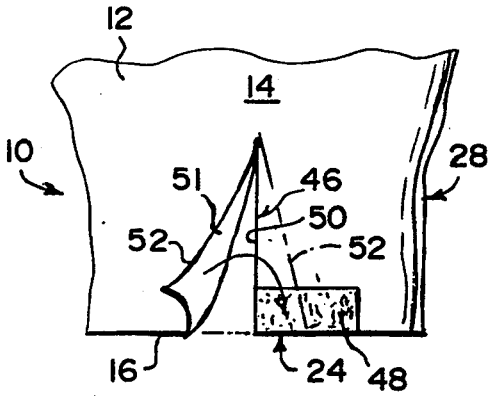
FIG. 4 is an enlarged elevational view with parts broken away showing a third embodiment of the instant invention.

The cuff securing mechanism 24, as shown in FIG. 4 for a third embodiment, includes the sheet 12 having a slit 46 extending inwardly from the cuff 16. A protected pressure sensitive adhesive strip 48 is affixed at a first side 50 of the slit 46 adjacent the cuff 16, so that a portion 51 of the sheet 12 at a second side 52 of the slit 46 adjacent the cuff 16 can flap over and engage with the surface of the adhesive strip 48, when a protective material is first removed therefrom, which will allow the cuff 16 to be restricted in size and thereby secure the mitten/glove 10 to the wrist 26.

The sanitary disposable hand covering 10, as shown in the drawings, is a mitten 28, but it can also be fabricated as a glove. The mitten 28 can be especially useful when worn on the hands 18 of a child, while the gloves are useful when worn on the hands 18 of an adult when entering a public rest room or other facility. The hand coverings 10 will keep the hands 18, as well as the thumbs 20 and fingers 22 clean, thereby reducing the spread of germs and eliminate contracting infections.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

It is claimed:

1. A sanitary disposable hand covering which comprises:

a ) a single sheet of thin, flexible, waterproof plastic material formed into an enclosure defining one of a mitten and glove having a thumb portion and a fingers portion, so that said thumb portion can be manipulated relative to said fingers portion, a cuff on said enclosure to permit a hand having a thumb and fingers to enter through said cuff for insertion into said enclosure; and b) means for securing said cuff about a wrist of the hand comprising a notch extending inwardly from said cuff, a rubber band and a folded heat sealed hem formed at an open end of said cuff to capture said rubber band therein, which will secure said cuff to the wrist.

2. A sanitary disposable hand covering according to claim 1 in which the heat sealed hem is folded externally of said cuff.

* * * * *